US005894730A

United States Patent [19]

Mitchell

[11] Patent Number: 5,894,730

[45] Date of Patent: Apr. 20, 1999

[54] INTERNAL COMBUSTION HYDRAULIC MOTOR AND METHOD OF OPERATION

[76] Inventor: Herman R. Mitchell, 4930 Strathaven Dr., Dayton, Ohio 45424

[21] Appl. No.: 08/910,705

[22] Filed: Aug. 13, 1997

[51] Int. Cl.[6] ..... F02B 71/04

[52] U.S. Cl. ..... 60/595; 417/380

[58] Field of Search ..... 60/595; 417/380, 417/381

[56] References Cited

U.S. PATENT DOCUMENTS

| | | | |
|---|---|---|---|
| 3,769,788 | 11/1973 | Korper, III | 60/19 |
| 3,995,974 | 12/1976 | Herron | 417/280 |
| 4,326,380 | 4/1982 | Rittmaster et al. | 417/380 X |
| 4,362,477 | 12/1982 | Patten | 417/380 X |
| 4,507,924 | 4/1985 | Hemphill | 60/595 |
| 4,730,990 | 3/1988 | Priem et al. | 417/380 X |
| 5,647,734 | 7/1997 | Milleron | 417/380 |
| 5,702,238 | 12/1997 | Simmons et al. | 417/380 |

*Primary Examiner*—Hoang Nguyen
*Attorney, Agent, or Firm*—Biebel & French

[57] ABSTRACT

An internal combustion hydraulic engine for use in motor vehicles and the like comprises at least one piston having a first piston head and a second piston head; a first or combustion cylinder at least partially surrounding the first piston head for receiving fuel and air; an igniter for inducing combustion of the fuel-air mixture in the first cylinder; and a second or hydraulic cylinder at least partially surrounding the second piston head for receiving fluid such that the action of the combustion of the fuel on the first piston head induces the second piston head to pressurize the fluid in the hydraulic cylinder. Preferably, the pressurized fluid communicates through a high pressure tank with a hydraulic motor to convert fluid pressure into rotational power.

15 Claims, 3 Drawing Sheets

INTERNAL COMBUSTION HYDRAULIC MOTOR AND METHOD OF OPERATION

BACKGROUND OF THE INVENTION

1. Field of the Invention

The present invention relates to internal combustion engines and more particularly to engines using internal combustion to pressurize hydraulic fluid.

2. Description of Related Art

A conventional internal combustion reciprocating engine for generating rotational movement includes a series of pistons pivotably coupled to a crankshaft. Each piston is at least partially surrounded by a stationary cylinder so as to define a combustion chamber between the piston and a head of the cylinder. The combustion of a liquid fuel such as gasoline in the combustion chamber produces hot, pressurized gas which drives the piston away from the cylinder head. The pivotable coupling between the piston and the crankshaft converts the linear movement of the piston through the cylinder into rotation of the crankshaft.

Such engines operate cyclically—that is, each cylinder and piston repeatedly perform a sequence of steps which coincide with the strokes of the piston. One conventional four stroke cycle common in automotive engines includes: (1) an intake stroke, during which the piston moves away from the cylinder head while fuel and air enter the combustion chamber; (2) a compression or return stroke, during which the piston moves back toward the cylinder head to compress the fuel-air mixture in the combustion chamber; (3) a combustion or power stroke, during which the fuel-air mixture in the combustion chamber is ignited, generating hot gas which drives the piston away from the cylinder head; and (4) an exhaust stroke, during which the exhaust gas is exhausted from the combustion chamber as the piston moves back toward the cylinder head.

The flow of fuel and exhaust gas through the combustion chamber is controlled by the piston and by valves positioned near the head of the cylinder. During the intake stroke, the piston moves away from the cylinder head, lowering the pressure in the combustion chamber and inducing fuel and air to enter the combustion chamber through one or more intake valves in the cylinder head. During the exhaust stroke, the piston moves back toward to the cylinder head and tends to push the exhaust gas out of the combustion chamber through an exhaust valve in the cylinder head. The intake and exhaust valves remain closed through the remainder of the cycle.

According to a conventional two-stroke cycle, combustion occurs each time the piston approaches the head of the cylinder. The hot, pressurized gas produced by the combustion of the fuel drives the piston away from the cylinder head. As the piston approaches the end of the power stroke, intake and outlet valves are opened, relieving the exhaust gas pressure in the combustion chamber. Fuel and air flow into the combustion chamber. Meanwhile, the piston begins its return stroke toward the cylinder head, compressing the fuel and air in preparation for combustion.

In a conventional reciprocating engine, a series of pistons are coupled to the same crankshaft. The timing of the strokes of different pistons are staggered so that, while one piston is undergoing its combustion stroke, other pistons are undergoing their intake, compression or exhaust strokes. In a conventional multi-piston engine, the rotational power transmitted to the crankshaft as one piston undergoes its combustion stroke drives other pistons through their intake, compression and exhaust strokes. Likewise, power drawn from the crankshaft opens and closes the intake and exhaust valves.

Conventional reciprocating engines typically include flywheels. The power supplied by the engine to the drive shaft is periodic rather than continuous in the sense that a burst of power is supplied each time a piston is fired. The flywheel tends to smooth out the power supplied by the engine over time to provide a constant torque to the drive shaft.

The efficiency of the engine relates, at least in part, to the duration of the combustion stroke. A longer stroke leads to more complete combustion of the fuel and to more efficient conversion of the gas pressure into mechanical work.

One drawback to conventional internal combustion reciprocating engines is that the duration of the combustion stroke is controlled by the speed at which the crankshaft rotates. In practice, this significantly limits the duration of the combustion stroke. While idling at 500 revolutions per minute (RPM), the combustion stroke of a conventional automotive engine lasts approximately one-sixteenth (1/16) second. At 2000 RPM, the approximate output of a conventional automotive engine of an automobile traveling 60 miles per hour, the combustion stroke of the engine lasts approximately one-sixtieth 1/60) second. This is simply not enough time for the fuel-air mixture to burn completely. At least partially as a result, the efficiency of conventional automotive engines is in the neighborhood of 18%.

Furthermore, the incomplete combustion of the fuel during the combustion stroke of a conventional four stroke cycle engine increases the pollution content of the exhaust. The residual pressure remaining in the exhaust gas when relieved from the cylinder increases the noise of the engine. Therefore, there remains a need in the art for an internal combustion engine capable of a longer power stroke.

SUMMARY OF THE INVENTION

The present invention provides an internal combustion hydraulic engine for use in motor vehicles and the like comprising at least one piston having a first piston head and a second piston head; a first or combustion cylinder at least partially surrounding the first piston head for receiving fuel and air; an igniter for inducing combustion of the fuel-air mixture in the first cylinder; and a second or hydraulic cylinder at least partially surrounding the second piston head for receiving fluid such that the action of the combustion of the fuel on the first piston head induces the second piston head to pressurize the fluid in the hydraulic cylinder. Preferably, the pressurized fluid communicates through a high pressure tank with a hydraulic motor to convert fluid pressure into rotational power.

Any number of pistons can be used to meet required power needs and for overall smoothness of operation. Each piston operates independently of the other pistons and of the drive shaft.

Since each piston operates independently of the other pistons and of the drive shaft, the duration of its power stroke is not limited by the timing of the other pistons or by the rotational speed of the drive shaft. Consequently, the combustion stroke of each piston can be timed independently to maximize its efficiency. Furthermore, since the flow rate of the pressurized hydraulic fluid through the hydraulic motor tends to be low, sufficient pressure can be maintained in the pressure tank despite the relatively long power strokes contemplated by the invention. Since the power strokes can be timed independently, the pistons may be of different sizes to allow for a broad range of pressure options.

According to a preferred embodiment, a plurality of valves regulates flow into, and out of, the first and second cylinders. At least one fuel intake valve admits the fuel and air into the combustion chambers and at least one exhaust valve relieves exhaust gas from the combustion chambers. The timing of these valves, along with the timing of the igniter, controls the duration of the power strokes of the pistons.

According to another preferred embodiment, the second piston heads each define a primary surface and a secondary surface so as to divide the second cylinders into primary chambers contiguous to the primary surfaces and secondary chambers contiguous to the secondary surfaces. The second piston heads each include at least one piston head check valve communicating between the first and second surfaces for admitting the fluid from the secondary chambers to the primary chambers.

According to yet another preferred embodiment, the engine includes a compressed air supply. The compressed air supply is used for fuel injection into the combustion chambers and also to provide back pressure to drive the return strokes of the pistons. A portion of the pressurized fluid from the pressure tank is bled off to run a hydraulic compressor to maintain the compressed air supply.

The engine operates most efficiently in a two stroke cycle. The combustion of fuel-air mixture drives the pistons through their power strokes. The compressed air drives the pistons through their return strokes. The fluid is pulled into the secondary chambers of the hydraulic cylinders during the power strokes and is drawn through the piston head check valves into the primary chambers during the return strokes. One skilled in the art will appreciate that, while the engine is preferably operated according to a two stroke cycle, it is within the contemplation of the invention to operate it according to a four stroke cycle as well.

The engine is preferably controlled electronically by means of an electronic control module. Preferably, the electronic control module includes a programmed microprocessor capable of selectively energizing the valves, the speed control and the igniter. By monitoring the power demanded by the operator as well as operating conditions such as engine speed and load, the electronic control module can manipulate the valves, the speed control and the igniter to maximize the efficiency of the engine.

The engine does not need a flywheel to smooth out the flow of power. The firing of the piston/cylinder assemblies may be timed to smooth out the pressure supplied to the pressure tank and the output shaft. In addition, the pressurized fluid communicates with the hydraulic motor through a pressure tank which maintains a relatively constant pressure behind the hydraulic motor. Likewise, the use of an electronic speed control across the high pressure feed to the hydraulic motor obviates the need for a separate transmission, though the engine of the present invention is operable with conventional transmissions.

Therefore, it is one object of the invention to provide an engine capable of improved efficiency in which the durations of the power strokes of the pistons are not controlled by the timing of the other pistons or the speed of the drive shaft. Other objects and advantages of the invention will be apparent from the following description, the accompanying drawings and the appended claims.

DETAILED DESCRIPTION OF THE PREFERRED EMBODIMENT

Figure 1:
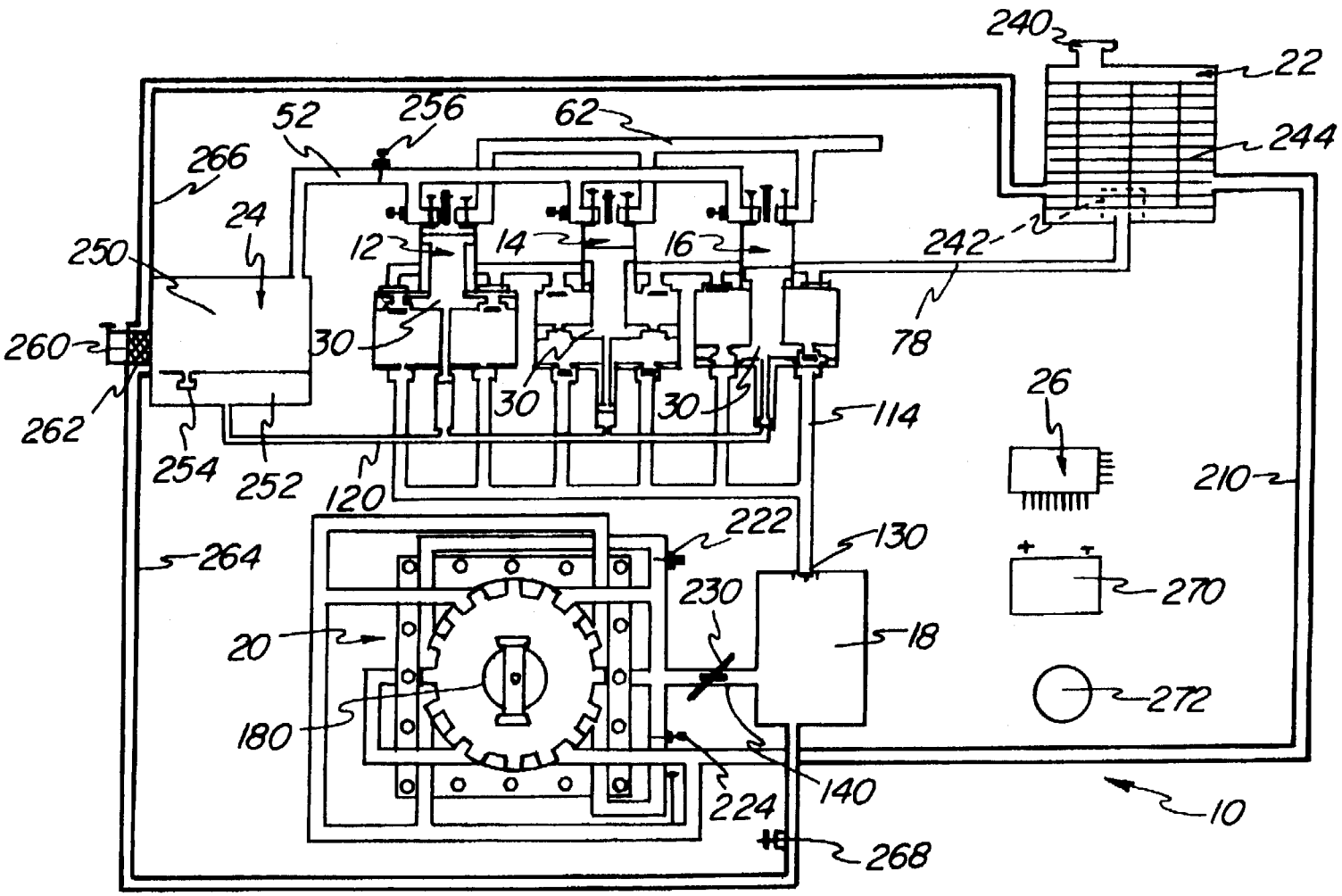
FIG. 1 is a schematic view of an internal combustion hydraulic engine according to the present invention.

Referring to FIG. 1, a three-cylinder internal combustion hydraulic engine 10 includes three piston/cylinder assemblies 12, 14 and 16; a pressure tank 18; a multi-stage hydraulic motor or drive unit 20; a low pressure hydraulic fluid supply 22; a compressed air supply 24; and an electronic control module 26. In the engine 10 shown, the three piston/cylinder assemblies 12, 14, 16 are identical in construction, though the use of piston/cylinder assemblies of different capacities in the same engine is within the contemplation of the invention.

Figure 2:
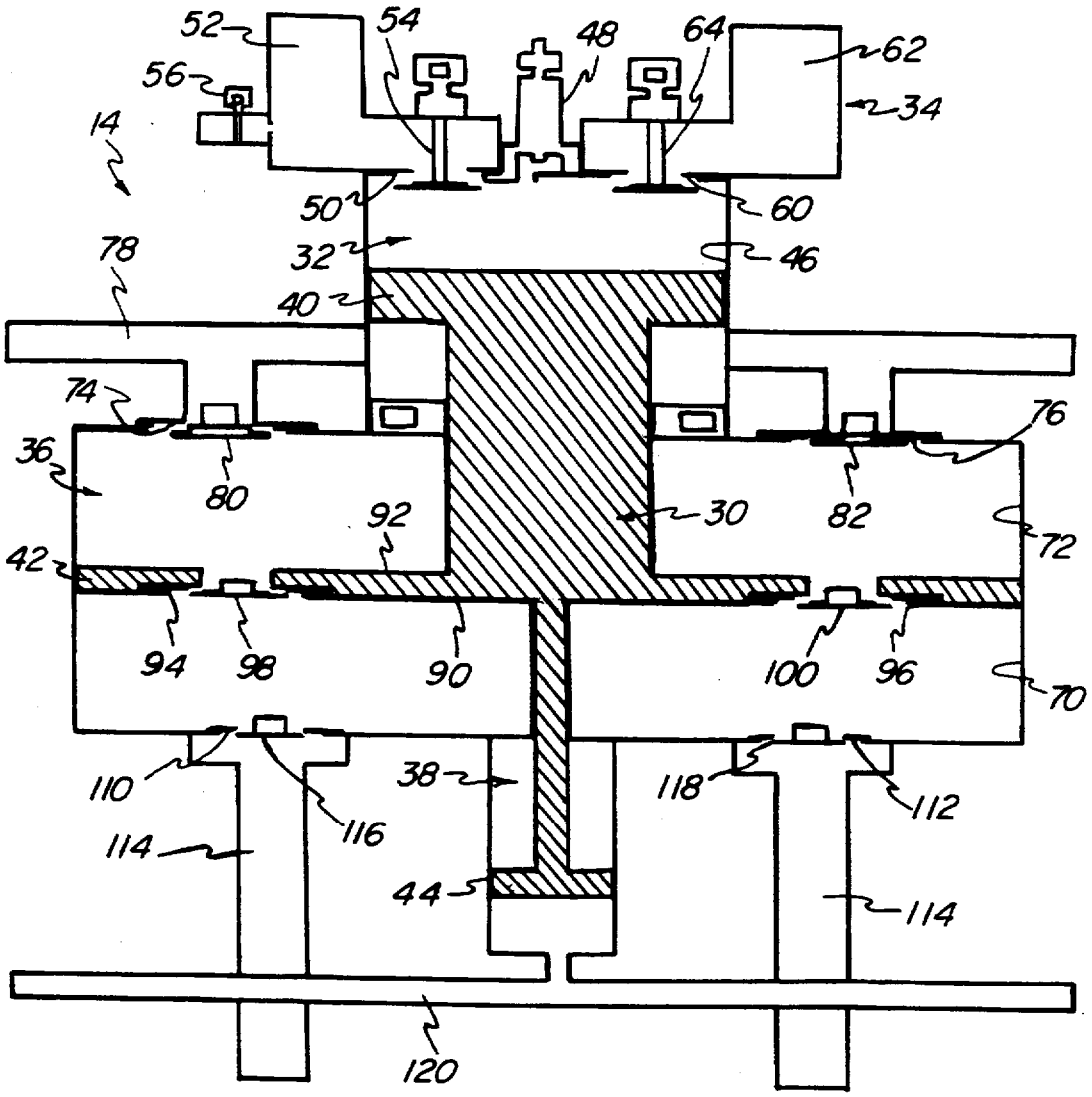
FIG. 2 is a schematic view of a piston/cylinder assembly for the internal combustion hydraulic engine of FIG. 1 during a stroke of the piston.

Referring to FIG. 2, the piston/cylinder assembly 14 includes a piston 30; a first or combustion cylinder 32 having a cylinder head 34; a second or hydraulic cylinder 36; and a third or return cylinder 38. The cylinders 32, 36 are preferably formed in a cylinder block (not shown) composed of a corrosion-resistant metal.

The piston 30, which is preferably a unitary member formed of corrosion-resistant metal, defines a first piston head 40, a second piston heal 42 and a third piston head 44. The combustion cylinder 32 surrounds the first piston head 40 and defines a combustion chamber 46 between the cylinder head 34 and the first piston head 40. A spark plug 48 projects through the cylinder head 34 into the combustion chamber 46 to serve as an igniter.

The cylinder head 34 defines a fuel intake port 50 which communicates between a fuel intake manifold 52 and the combustion chamber 46. A solenoid fuel intake valve 54 is seated in the fuel intake port 50 to admit fuel from the fuel intake manifold 52 into the combustion chamber 46.

A solenoid fuel injection valve 56 is positioned on the fuel intake manifold 52 near the fuel intake port 50. A measured volume of fuel is admitted into the fuel intake manifold 52 through the fuel injection valve 56 for mixture with compressed air in the fuel intake manifold 52. The pressure of the compressed air serves to pressurize the fuel-air mixture entering the combustion chamber 46 through the fuel intake port 50, thereby obviating the need for a separate compression stroke of the piston 30.

The cylinder head 34 also defines an exhaust port 60 communicating between the combustion chamber 46 and an exhaust manifold 62. A solenoid exhaust valve 64 is seated in the exhaust port 60 to relieve exhaust gas from the combustion chamber 46 to the exhaust manifold 62.

The hydraulic cylinder 36 surrounds the second piston head 42. The second piston head 42 divides the hydraulic cylinder 36 into a primary chamber 70 and a secondary chamber 72. The hydraulic cylinder 36 defines a pair of hydraulic fluid intake ports 74 and 76 through which a low pressure hydraulic fluid intake manifold 78 communicates with the secondary chamber 72. A pair of hydraulic fluid intake check valves 80 and 82 are seated in the hydraulic fluid intake ports 74, 76 for admitting hydraulic fluid into the secondary chamber 72.

A primary surface 90 of the second piston head 42 is contiguous to the primary chamber 70 while a secondary surface 92 of the second piston head 42 is contiguous to the secondary chamber 72. The second piston head 42 defines a pair of piston head ports 94 and 96 which communicate between the secondary chamber 72 and the primary chamber 70. A pair of piston head check valves 98 and 100 are seated in the piston head ports 94, 96 for conducting fluid from the secondary chamber 72 to the primary chamber 70.

The hydraulic cylinder 36 defines a pair of hydraulic fluid outflow ports 110 and 112 for conducting pressurized hydraulic fluid out of the primary chamber 70 into a high pressure hydraulic fluid outflow manifold 114. A pair of outflow check valves 116 and 118 are seated in the hydraulic fluid outflow ports 110, 112.

The return cylinder 38 surrounds the third piston head 44. Compressed air from a precharge pressure manifold 120 maintains a continuous back pressure in the return cylinder 38 against the third piston head 44. The area of the third piston head 44 is preferably less than the area of the first piston head 40 so that the force applied to the first piston head 40 during combustion is significantly greater than the force applied by the compressed air against the third piston head 44.

The piston/cylinder assembly 14 preferably operates according to a two stroke cycle. Immediately prior to combustion, the first piston head 40 is positioned near the cylinder head 34. Fuel-air mixture fills the combustion chamber 46 between the first piston head 40 and the cylinder head 34. The fuel intake valve 54 and the exhaust valve 64 are both closed. The second piston head 42 is positioned near the hydraulic fluid intake ports 74, 76 and the primary chamber 70 of the hydraulic cylinder 36 is filled with hydraulic fluid.

An arc of electrical energy from the spark plug 48 ignites the fuel-air mixture to generate hot, pressurized gas in the combustion chamber 46. This hot, pressurized gas presses on the first piston head 40 to drive the piston 30 away from the cylinder head 34 through the position shown in FIG. 2.

As the piston 30 slides away from the cylinder head 34, the second piston head 42 compresses the hydraulic fluid in the primary chamber 70, forcing that fluid through the outflow check valves 116, 118. The back pressure of the fluid closes the piston head check valves 98, 100. Meanwhile, the expansion of the secondary chamber 72 of the hydraulic cylinder 36 draws low pressure hydraulic fluid through the hydraulic fluid intake check valves 80, 82 into the secondary chamber 72. Preferably, the primary surface 90 of the second piston head 42 has an area several times (for example, three times) an area of the first piston head 40 so as to provide a mechanical advantage in compressing the hydraulic fluid in the primary chamber 70.

The combustion of the fuel-air mixture drives the piston 30 through its power stroke against the back pressure of compressed air in the return cylinder 38. In a preferred embodiment of the invention, the combustion of the fuel-air mixture in the combustion chamber generates a force approximately sixteen (16) times the force induced by the continuous back pressure of compressed air on the third piston head 44. As a result, the force of the compressed air on the third piston head 44 does not significantly diminish the efficiency of the power stroke.

When it is desired to begin the return stroke of the piston 30, the exhaust valve 64 is opened to relieve gas pressure in the combustion chamber 46. At this point, the back pressure of the compressed air in the return cylinder 38 presses against the third piston head 44 to slide the piston 30 toward the cylinder head 34. The back pressure closes the outflow check valves 116, 118 and the hydraulic fluid intake check valves 80, 82 to prevent back flow of the hydraulic fluid. Meanwhile, the piston head check valves 98, 100 open so that hydraulic fluid flows from the secondary chamber 72 into the primary chamber 70 for compression during the next power stroke of the piston 30.

The fuel and compressed air mix adjacent the fuel injection valve 56 before entering the combustion cylinder 32. During the return stroke of the piston 30, the fuel intake valve 54 opens and the fuel-air mixture is injected into the combustion chamber 46 under pressure from the compressed air supply 24 (FIG. 1).

Referring again to FIG. 1, the piston/cylinder assemblies 12, 14, 16 communicate with the pressure tank 18 through the high pressure hydraulic fluid manifold 114. The pressure tank 18, which is preferably a tank formed from noncorrosive metal having wails thick enough to contain the pressurized hydraulic fluid, includes a pressure tank check valve 130 seated in a port (not shown) through which the high pressure hydraulic manifold 114 communicates with an interior of the pressure tank 18.

Figure 3:
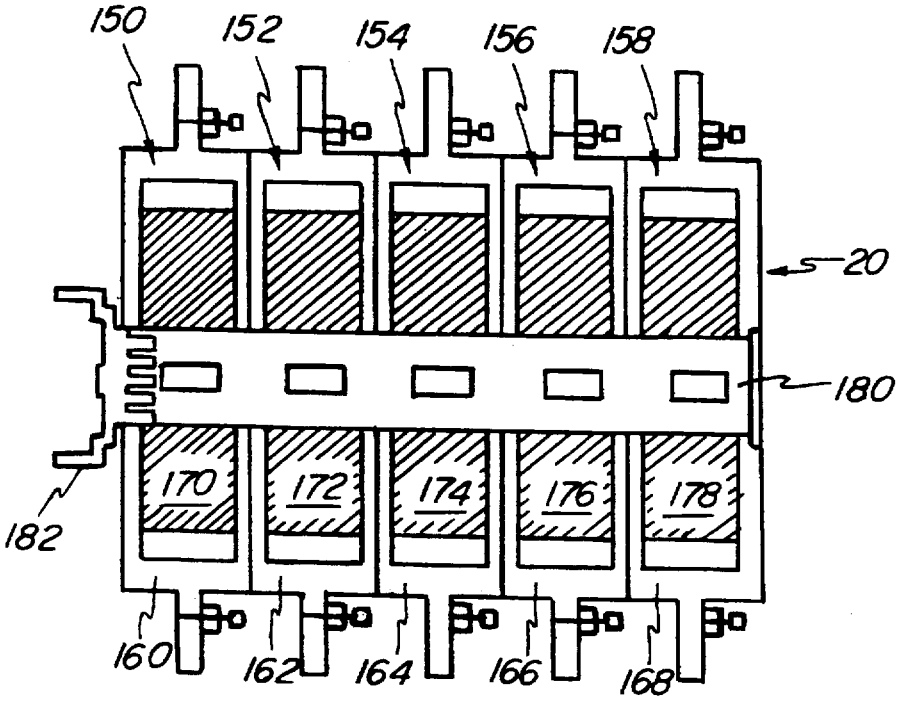
FIG. 3 is a schematic view of a multi-stage hydraulic motor or drive unit for the engine of FIG. 1.

The pressure tank 18 communicates with the multi-stage hydraulic motor 20 through a high pressure feed pipe 140. Referring to FIG. 3, the multi-stage hydraulic motor 20 comprises a series of stages 150, 152, 154, 156 and. 158. Each stage 150, 152, 154, 156, 158 includes a casing 160, 162, 164, 166 and 168 and a rotor 170, 172, 174, 176 and 178.

Each of the rotors 170, 172, 174, 176, 178 is fixed to a common output shaft 180 in a conventional manner. A coupling 182 is provided at one end of the common output shaft 180 for transmitting power to a motor vehicle drive shaft (not shown) or other external load.

Those skilled in the art will appreciate that the number of stages 150, 152, 154, 156, 158 and the geometries of the rotors 170, 172, 174, 176, 178 may be varied without departing from the principal of the present invention. Preferably, the diameters of the rotors 170, 172, 174, 176, 178 are several times (for example, three times) the diameter of the common output shaft 180 to provide a mechanical advantage.

Figure 4:
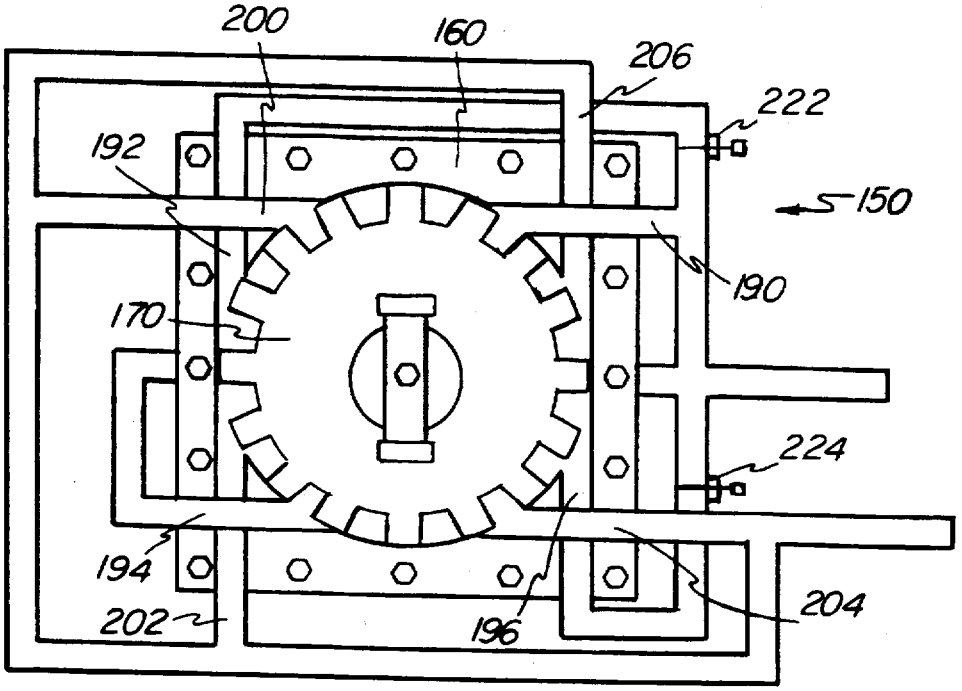
FIG. 4 is a schematic view of one stage of the multi-stage hydraulic motor of FIG. 3.

Pressurized hydraulic fluid entering the hydraulic motor 20 through the high pressure feed pipe 140 (FIG. 1) is divided among the stages 150, 152, 154, 156, 158. Referring to FIG. 4, the pressurized hydraulic fluid entering one of the stages (150 in FIG. 4) is preferably further divided among a plurality of high pressure feed conduits 190, 192, 194 and 196 impinging tangentially on the rotor 170. The pressure of the hydraulic fluid impinging tangentially on the rotor 170 from the high pressure feed conduits 190, 192, 194, 196 induces rotation of the rotor 170 and the common output shaft 180.

Corresponding low pressure return conduits 200, 202, 204 and 206 collect the hydraulic fluid from the high pressure feed conduits 190, 192, 194, 196 and conduct the hydraulic fluid to a low pressure return pipe 210 (FIG. 1). While four high pressure feed conduits 190, 192, 194, 196 and four low pressure return conduits 200, 202, 204, 206 have been shown, the number of high pressure feed and low pressure return conduits is not critical to the invention.

Solenoid power selector valves 222, 224 (only two shown in FIG. 4) across each of the inflow conduits 190, 192, 194, 196 regulate the flow rate and power transmitted to the rotor 170. In addition, referring to FIG. 1, an electronic speed control 230 is positioned across the high pressure feed pipe 140 to regulate the flow rate of the hydraulic fluid through the hydraulic motor 20 in a manner well known to those skilled in the art. By regulating the flow rate through the hydraulic motor 20, the speed control 230 likewise regulates the rotational speed of the common output shaft 180.

The low pressure hydraulic fluid supply 22 includes a tank having a refill opening (not shown) covered by a cap 240 for replenishing the supply of hydraulic fluid. The fluid supply 22 dispenses low pressure hydraulic fluid to the piston/cylinder assemblies 12, 14, 16 by force of gravity through the low pressure hydraulic fluid intake manifold 78. Preferably, a filter 242 is provided in the fluid supply 22 for removing particulates such as metal shavings from the hydraulic fluid before the fluid is dispensed. The fluid supply 22 receives low pressure hydraulic fluid back from the hydraulic motor 20 through the low pressure return pipe 210. Heat dissipation means 244 such as a heat exchanger is mounted to the fluid supply 22 to dissipate heat generated during the operation of the engine 10.

Preferably, the low pressure hydraulic fluid supply 22 maintains a supply of low pressure hydraulic fluid as long as the engine 10 is operating. The low pressure hydraulic fluid serves to cushion the pistons 30 as they reach the ends of their strokes to prevent collisions between the piston heads 40, 42, 44 (only one set shown in FIG. 2) and the ends of the cylinders 32, 36, 38 (only one set shown in FIG. 2) which could reduce the lives of the piston/cylinder assemblies 12, 14, 16.

The compressed air supply 24 likewise includes a fuel injection charge tank 250 communicating with a return cylinder precharge tank 252 through a compressed air supply check valve 254. The fuel injection charge tank 250 communicates with the piston/cylinder assemblies 12, 14, 16 through the fuel intake manifold 52. The tank 250 provides both air for forming the fuel-air mixture and pressure for fuel injection into the combustion chambers 46 (only one shown in FIG. 2) of the piston/cylinder assemblies 12, 14, 16. A solenoid injection valve 256 regulates the pressure of the compressed air entering the fuel intake manifold 52.

The return cylinder precharge tank 252 provides compressed air to the return cylinders 38 (only one shown in FIG. 2) of the piston/cylinder assemblies 12, 14, 16 through the precharge pressure manifold 120 to drive the return strokes of the pistons 30. The compressed air supply check valve 254 serves to isolate the compressed air in the return cylinder precharge tank 252 from pressure variations in the fuel injection charge tank 250 to maintain a constant pressure in the precharge pressure manifold 120.

An electric motor 260 and an auxiliary hydraulic motor 262 are coupled to operate a centrifugal compressor or other conventional means (not shown) to force compressed air into the fuel injection charge tank 250. The electric motor 260 is powered by a battery 270 and is used primarily to build up pressure in the compressed air supply 24 during start-up.

During engine operation, the auxiliary hydraulic motor 262 bears most of the work of maintaining air pressure in the compressed air supply 24 in order to conserve the charge on the battery 270. While the engine is running, an auxiliary motor feed line 264 supplies high pressure hydraulic fluid from the pressure tank to the auxiliary hydraulic motor 262 and an auxiliary motor return line 266 returns the low pressure hydraulic fluid to the low pressure hydraulic fluid supply 22. A solenoid auxiliary hydraulic motor control valve 268 controls the flow of high pressure hydraulic fluid to the auxiliary hydraulic motor 262.

The valves 54 (only one shown in FIG. 2), 64 (only one shown in FIG. 2), 222, 224, 256, 268; the speed control 230; the spark plugs 48 (only one shown in FIG. 2); and the electric motor 260 are selectively energized by an electronic control module 26, which preferably comprises a programmed microprocessor powered by the battery 270. Preferably, an alternator 272 is provided to maintain the charge of the battery 270. According to a preferred embodiment, the alternator 272 is mounted to the hydraulic motor 20 so that it operates whenever torque is supplied to the common output shaft 180. According to an alternative embodiment, the alternator 272 is mounted on a high pressure line bled off from the pressure tank 18.

The electronic control module 26, through one or more switches or sensors (not shown) whose arrangement is within the skill in the art, monitors conditions in the engine and the power demanded by the operator. The electronic control module 26 is programmed to respond to these conditions by controlling the firing of the pistons and the flow of high pressure hydraulic fluid to supply the power demanded by the operator.

During start-up after prolonged disuse, the electronic control module 26 turns on the electric motor 260 to generate air pressure in the precharge pressure manifold 120 to reset the pistons 30 of the piston/cylinder assemblies 12, 14, 16 for firing. On the order of five to ten seconds of run time is required to pressurize the precharge pressure manifold 120 and to reset the piston/cylinder assemblies 12, 14, 16. During this process, the compressed air supply check valve 254 serves to isolate the electric motor 260 from pressure variations in the precharge pressure manifold 120 due to the movement of the pistons 30.

One or more of the piston/cylinder combinations 12, 14, 16 is then fired to begin building hydraulic pressure in the pressure tank 18. During this process, the electronic control module 26 regulates the power and return strokes of the pistons 30 of the piston/cylinder assemblies 12, 14, 16 by controlling the fuel intake valve 54 (only one shown in FIG. 2), the exhaust valve 64 (only one shown in FIG. 2) and the spark plug 48 (only one shown in FIG. 2) of each piston/cylinder assembly 12, 14, 16. In particular, the electronic control module 26 regulates the lengths of the power strokes of the pistons 30 by controlling the lengths of time between the ignitions of the fuel air mixture by the spark plugs 48 (only one shown in FIG. 2) and the openings of the exhaust valves 64 (only one shown in FIG. 2) to relieve the gas pressures in the combustion chambers 46 (only one shown in FIG. 2).

In an embodiment in which the engine 10 is used to power a truck or other heavy motor vehicle (not shown), the electronic control module 26 monitors the weight of the truck and its load (not shown) through the use of conventional sensors (not shown) in a manner known to those skilled in the art. During start-up, the electronic control module 26 may use information concerning the weight of the truck and its load to determine the number of piston/cylinder assemblies 12, 14, 16 to fire to insure sufficient hydraulic pressure in the pressure tank 18 to meet demand.

Preferably, once the engine 10 is in operation, the electronic control module 26 times the firing of the piston/cylinder assemblies 12, 14, 16 to maintain sufficient pressure in the pressure tank 18 to meet demand. The electronic control module 26 also regulates the speed control 230 so that the common output shaft 180 meets the RPM and torque demands of the operator. In an embodiment in which the engine 10 is used to power a motor vehicle, the electronic control module 26 monitors the speed of the vehicle by means of a conventional sensor (not shown) and controls the rate of firing of the piston/cylinder assemblies 12, 14, 16 to maintain constant speed and power. No separate transmission is required to regulate the speed and torque of the common output shaft 180.

During periods of time in which no torque is demanded from the common output shaft 180, the fuel intake valve 54 (only one shown in FIG. 2) and the exhaust valve 64 (only one shown in FIG. 2) preferably remain closed to maintain the gas pressure on the combustion chamber 46 (only one shown in FIG. 2). This permits the engine 10 to maintain working pressure in the high pressure hydraulic fluid manifold 114 for at least a limited period of time without burning additional fuel. As time passes, however, the gas pressure in the combustion chamber 46 (FIG. 2) decreases due to the cooling of the gas. Thus, one skilled in the art will recognize the necessity for additional piston cycles to maintain hydraulic pressure to meet demand if the engine 10 idles for a long period of time.

As hydraulic pressure builds in the pressure tank 18, the auxiliary hydraulic motor 262 assumes more of the work of supplying compressed air to the compressed air source 24 from the electric motor 260. The operation of the auxiliary hydraulic motor 262 conserves electrical power by permitting the electronic control module 26 to reduce the power drawn by the electric motor 260 while maintaining a desired level of air pressure in the compressed air supply 24. Ideally, the electric motor 260 is turned off entirely when the pressure tank 18 approaches a working pressure level.

One advantage of the engine 10 of the present invention is that the duration of the power strokes of the pistons 30 of the piston/cylinder assemblies 12, 14, 16 is not dependent on the timing of the other piston/cylinder assemblies or on the speed of the common output shaft 180. Consequently, the electronic control module 26 can be programmed to time the power stroke of each piston 30 to maximize the efficiency of the piston/cylinder assemblies 12, 14, 16. Furthermore, since the flow rate of the pressurized hydraulic fluid through the hydraulic motor 20 is low, sufficient pressure can be maintained in the pressure tank 18 despite the relatively long power strokes of the pistons 30.

According to one alternative mode of operation, the electronic control module 26 is programmed to direct pressurized exhaust gas from one or more of the piston/cylinder assemblies 12, 16 to the combustion chamber 46 (FIG. 2) of the piston/cylinder assembly 14 to drive the piston 30 (FIG. 2) of the piston/cylinder assembly 14 through its power stroke. This is accomplished by directing the exhaust gas through the exhaust manifold 62 and into the combustion chamber 46 (FIG. 2) of the piston/cylinder assembly 14 through its exhaust port 62 and exhaust valve 64. This practice increases the efficiency of the engine 10 by deriving additional work from the residual pressure remaining after the exhaust gas is emitted from the piston cylinder assemblies 12, 16.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended clams.

What is claimed is:

1. An engine for generating torque comprising:

at least one piston having a first piston head and a second piston head;

a first cylinder at least partially surrounding the first piston head for receiving fuel;

an igniter for inducing combustion of the fuel in the first cylinder;

a second cylinder at least partially surrounding the second piston head for receiving fluid such that the action of the combustion of the fuel on the first piston head induces the second piston head to pressurize the fluid in the second cylinder;

a pressure tank communicating with the second cylinder for receiving the fluid from the second cylinder;

a hydraulic motor including an output shaft the hydraulic motor communicating with the pressure tank to receive a flow of the fluid from the pressure tank and induce rotation of the output shaft; and a low pressure hydraulic fluid supply communicating with the second cylinder for maintaining a supply of the hydraulic fluid.

2. The engine as recited in claim 1 wherein the first cylinder includes at least one first cylinder intake valve for admitting the fuel to the first cylinder and at least one first cylinder exhaust valve for relieving exhaust gas produced by the combustion of the fuel from the first cylinder.

3. An engine comprising:

at least one piston having a first piston head and a second piston head;

a first cylinder at least partially surrounding the first piston head for receiving fuel;

an igniter for inducing combustion of the fuel in the first cylinder;

a second cylinder at least partially surrounding the second piston head for receiving fluid such that the action of the combustion of the fuel on the first piston head induces the second piston head to pressurize the fluid in the second cylinder;

said second piston defining a primary surface and a secondary surface so as to divide the second cylinder into a primary chamber contiguous to the primary surface and a secondary chamber contiguous to the secondary surface; and wherein the second piston head includes at least one piston head check valve communicating between the primary and secondary surfaces for admitting the fluid from the primary chamber into the secondary chamber.

4. The engine as recited in claim 3 wherein the second cylinder includes at least one second cylinder intake check valve for admitting fluid to the secondary chamber.

5. The engine as recited in claim 4 wherein the second cylinder includes at least one second cylinder outflow check valve for relieving the fluid from the second cylinder.

6. An engine comprising:

at least one piston having a first piston head, a second piston head and a third piston head;

a first cylinder at least partially surrounding the first piston head for receiving fuel;

an igniter for inducing combustion of the fuel in the first cylinder;

a second cylinder at least partially surrounding the second piston head for receiving fluid such that the action of the combustion of the fuel on the first piston head induces the second piston head to pressurize the fluid in the second cylinder; and a third cylinder at least partially enclosing the third piston head for cooperation with the third piston head to reposition the first and second piston heads in the first second cylinders.

7. The engine as recited in claim 6 including a compressed air supply communicating with the third cylinder for cooperation with the third piston head to reposition the first and second piston heads in the first and second cylinders.

8. The engine as recited in claim 1 wherein the first cylinder includes at least one first cylinder intake valve for admitting the fuel to the first cylinder and at least one first cylinder exhaust valve for relieving exhaust gas produced by the combustion of the fuel from the first cylinder;

the engine including an electronic control module for selectively energizing the first cylinder intake valve, the first cylinder exhaust valve and the igniter.

9. The engine as recited in claim 8 including an electronic speed control for regulating the flow of the fluid from the pressure tank, the electronic speed control being selectively engergized by the electronic control module.

10. A method for generating pressure in a fluid by means of the combustion of a fuel-air mixture in an engine including at least one piston/cylinder assembly having a piston including a first piston head and a second piston head, a combustion cylinder cooperating with the first piston head to define a combustion chamber, a hydraulic cylinder cooperating with the second piston head to define a primary chamber, and a compressed air supply tending to drive the piston toward a first position, the method comprising the steps of:

introducing the fluid into the primary chamber;

burning the fuel-air mixture to generate pressurized gas in the combustion chamber to drive the piston from the first position toward a second position to pressurize the fluid in the primary chamber; and relieving the pressurized gas from the combustion chamber, whereby the compressed air supply drives the piston toward the first position.

11. The method as recited in claim 10 including the additional steps of injecting the fuel-air mixture into the combustion chamber under pressure and igniting the fuel-air mixture.

12. A method for generating pressure in a fluid by means of the combustion of a fuel-air mixture in an engine including at least one piston/cylinder assembly having a piston including a first piston head and a second piston head, a combustion cylinder cooperating with the first piston head to define a combustion chamber, a hydraulic cylinder at least partially surrounding the second piston head to define a primary chamber and a secondary chamber, and a compressed air supply tending to drive the piston toward a first position, the method comprising the steps of:

introducing the fluid into the primary chamber;

burning the fuel-air mixture to generate pressurized gas in the combustion chamber to drive the piston from the first position toward a second position to pressurize the fluid in the primary chamber;

introducing additional fluid into the secondary chamber while the piston is being driven from the first position toward the second position;

relieving the pressurized gas from the combustion chamber, whereby the compressed air supply drives the piston toward the first position;

introducing the additional fluid into the primary chamber by moving the additional fluid from the secondary chamber through the second piston head into the primary chamber as the piston is being driven toward its first position; and burning an additional fuel-air mixture in the combustion chamber to drive the piston toward its second position to pressurize the additional fluid in the primary chamber.

13. A method for generating pressure in a fluid by means of the combustion of a fuel-air mixture in an engine including first and second piston/cylinder assemblies, each of said first and assemblies, each of said first and second piston including a first piston head and a second piston head a combustion cylinder cooperating with the first piston head to define a combustion chamber, a hydraulic cylinder cooperating with the second piston head to define a primary chamber, the method comprising the steps of:

introducing the fluid into the primary chambers of the first and second piston/cylinder assemblies;

burning the fuel-air mixture to generate pressurized gas in the combustion chamber of the first piston/cylinder assembly to drive the piston of the first piston/cylinder assembly from its first position toward a second position;

relieving the pressurized gas from the combustion chamber of the first piston/cylinder assembly to drive the piston of the first piston/cylinder assembly toward its first position; and directing the pressurized gas to the combustion chamber of the second piston/cylinder assembly to pressurize the fluid in the primary chamber of the second piston/cylinder assembly.

14. An engine comprising:

at least one piston having a first piston head, a second piston head, and a third piston head;

a first cylinder at least partially surrounding the first piston head to define a combustion chamber for receiving fuel;

the first cylinder including at least one first cylinder intake valve for admitting the fuel to the combustion chamber and at least one first cylinder exhaust valve for relieving exhaust gas produced by the combustion of the fuel from the combustion chamber;

an igniter for inducing combustion of the fuel in the combustion chamber;

a second cylinder at least partially surrounding the second piston head for receiving fluid;

the second piston defining a primary surface and a secondary surface so as to divide the second cylinder into a primary chamber contiguous to the primary surface and a secondary chamber contiguous to the secondary surface;

the second piston head including at least one piston head check valve communicating between the primary and secondary surfaces for admitting the fluid from the primary chamber to the secondary chamber;

the second cylinder including at least one second cylinder intake check valve for admitting fluid to the secondary chamber and at least one second cylinder outflow check valve for relieving the fluid from the primary chamber such that the action of the combustion of the fuel on the first piston head induces the second piston head to pressurize the fluid in the second cylinder;

a third cylinder at least partially enclosing the third piston head;

a compressed air supply communicating with the third cylinder for cooperation with the third piston head to reposition the first and second piston heads in the first and second cylinders;

a pressure tank communicating with the second cylinder through the at least one second cylinder outflow check valve for receiving the fluid from the second cylinder;

a hydraulic motor communicating with the pressure tank to receive a flow of the fluid from the pressure tank;

a speed control for regulating the flow of the fluid from the pressure tank toward the hydraulic motor; and an electronic control module for selectively energizing the first cylinder intake valve, the first cylinder exhaust valve, the igniter and the speed control.

15. The engine as recited in claim 14 including an electric motor for generating the compressed air source; an auxiliary hydraulic motor coupled to the electric motor; and an auxiliary motor high pressure feed line communicating between the pressure tank and the auxiliary hydraulic motor.

* * * * *